US007181414B1

(12) United States Patent
Ogawa et al.

(10) Patent No.: US 7,181,414 B1
(45) Date of Patent: Feb. 20, 2007

(54) ELECTRONIC TOLL COLLECTION SYSTEM FOR TOLL ROAD

(75) Inventors: Takao Ogawa, Yokohama (JP); Kazuhiro Morisaki, Fujinomiya (JP); Koji Nishikigi, Kawasaki (JP); Shigeki Kaneko, Fujisawa (JP); Shinichiro Kawasaki, Yokohama (JP); Hirokazu Wada, Yokohama (JP); Kenji Yaegashi, Kawasaki (JP); Seiji Fuyama, Yokahama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/394,514

(22) Filed: Sep. 13, 1999

(30) Foreign Application Priority Data

Sep. 16, 1998 (JP) ..... 10-279340

(51) Int. Cl.
*G07B 15/00* (2006.01)

(52) U.S. Cl. ..... 705/13; 340/928; 701/1

(58) Field of Classification Search ..... 705/13; 340/933; 701/1
See application file for complete search history.

(56) References Cited

U.S. PATENT DOCUMENTS 4,325,146 A * 4/1982 Lennington ..... 398/108
4,338,587 A * 7/1982 Chiappetti ..... 340/505
4,947,353 A * 8/1990 Quinlan, Jr. ..... 235/384
5,072,380 A * 12/1991 Randelman et al. ..... 705/13
5,086,389 A * 2/1992 Hassett et al. ..... 705/13
5,101,200 A * 3/1992 Swett ..... 340/937
5,227,803 A * 7/1993 O'Connor et al. ..... 342/442
5,310,999 A * 5/1994 Claus et al. ..... 235/384
5,321,490 A * 6/1994 Olson et al. ..... 356/5.03
5,406,275 A * 4/1995 Hassett et al. ..... 235/384
5,488,360 A * 1/1996 Ray ..... 340/933
5,602,375 A * 2/1997 Sunahara et al. ..... 235/384
5,648,767 A * 7/1997 O'Conner et al. ..... 340/928
5,686,906 A * 11/1997 Ono et al. ..... 340/928

(Continued)

FOREIGN PATENT DOCUMENTS

JP 5-274506 10/1993

(Continued)

OTHER PUBLICATIONS

Bair, Jeffrey. "AT&T, Lockhead join to create 'smart' roads," Houston Chronicle, Apr. 13, 1992.*

(Continued)

*Primary Examiner*—Tariq R. Hafiz
*Assistant Examiner*—Catherine M. Tarae
(74) *Attorney, Agent, or Firm*—Louis Woo

(57) ABSTRACT

An ETC (electronic toll collection) system includes an antenna having a predetermined directivity for providing a limited radio-communication service zone. A vehicle sensor operates for detecting a vehicle which reaches a predetermined position in the limited radio-communication service zone. A radio signal is transmitted via the antenna. A decision is made as to whether or not a radio response to the radio signal is received via the antenna. In cases where a radio response to the radio signal is received, it is judged that there is an ETC vehicle incoming. In cases where the vehicle sensor detects a vehicle while a radio response to the radio signal is not received, it is judged that there is a non-ETC vehicle incoming.

11 Claims, 5 Drawing Sheets

U.S. PATENT DOCUMENTS

| | | | | | |
|---|---|---|---|---|---|
| 5,705,996 | A | * | 1/1998 | Eguchi et al. | 340/928 |
| 5,710,743 | A | * | 1/1998 | Dee et al. | 368/90 |
| 5,793,491 | A | * | 8/1998 | Wangler et al. | 356/398 |
| 5,805,082 | A | * | 9/1998 | Hassett | 340/928 |
| 5,933,096 | A | * | 8/1999 | Tsuda | 340/928 |
| 6,040,785 | A | * | 3/2000 | Park et al. | 340/928 |
| 6,091,344 | A | * | 7/2000 | Park et al. | 235/384 |
| 6,109,525 | A | * | 8/2000 | Blomqvist et al. | 235/384 |
| 6,140,941 | A | * | 10/2000 | Dwyer et al. | 340/928 |

FOREIGN PATENT DOCUMENTS

| | | | |
|---|---|---|---|
| JP | 8-202907 | | 9/1996 |
| JP | 10040433 | A * | 2/1998 |

OTHER PUBLICATIONS

Flagg, Michael. "On the Move Traffic Engineers Have Given the Green Light to Technology. . . " the Los Angeles Times, Mar. 7, 1993.*

"Skokie toll collector accused of shortchanging state," Pantagraph, Mar. 5, 1995.*

Mathias, Craig. "The evolution of asset tracking technolgoy," Automatic I.D. News, May 1998.*

"Electronic Toll System Gets Whitman Approval," Record, Apr. 3, 1997.*

"MFS Transportation Systems Selected for Electronic Toll Collection in Richmond,VA," Fiber Optics Weekly Update, May 8, 1998.*

* cited by examiner

ELECTRONIC TOLL COLLECTION SYSTEM FOR TOLL ROAD

BACKGROUND OF THE INVENTION

1. Field of the Invention

This invention relates to an electronic toll collection system (an ETC system) for a toll road.

2. Description of the Related Art

In an ETC system for a toll road, when every ETC vehicle passes through a tollgate, an accounting machine in the tollgate and the ETC vehicle communicate with each other by wireless to automatically implement an accounting process. Accordingly, it is unnecessary for the ETC vehicle to pause at the tollgate to pay toll. The ETC vehicle means a vehicle designed for the ETC system.

The ETC system can not automatically implement an accounting process with respect to a non-ETC vehicle. The non-ETC vehicle means a vehicle not adapted to the ETC system. It is necessary for the tollgate in the ETC system to discriminate non-ETC vehicles from ETC vehicles, and to guide the non-ETC vehicles to a booth where toll can be manually paid. It is desirable to provide a high accuracy of discrimination of non-ETC vehicles from ETC vehicles.

SUMMARY OF THE INVENTION

It is an object of this invention to provide an electronic toll collection system (an ETC system) for a toll road which is able to accurately discriminate non-ETC vehicles from ETC vehicles.

A first aspect of this invention provides an ETC system comprising an antenna having a predetermined directivity for providing a limited radio-communication service zone; a vehicle sensor for detecting a vehicle which reaches a predetermined position in the limited radio-communication service zone; first means for transmitting a radio signal via the antenna; second means for deciding whether or not a radio response to the radio signal is received via the antenna; third means for, in cases where the second means decides that a radio response to the radio signal is received, judging that there is an ETC vehicle incoming; and fourth means for, in cases where the vehicle sensor detects a vehicle while the second means decides that a radio response to the radio signal is not received, judging that there is a non-ETC vehicle incoming.

A second aspect of this invention is based on the first aspect thereof, and provides an ETC system wherein the first means comprises means for continuously transmitting the radio signal via the antenna.

A third aspect of this invention is based on the first aspect thereof, and provides an ETC system wherein the limited radio-communication service zone has a length greater than a length of a standard vehicle and smaller than twice the length of the standard vehicle.

A fourth aspect of this invention is based on the first aspect thereof, and provides an ETC system wherein the limited radio-communication service zone has a length of about 6.5 m along a lane.

A fifth aspect of this invention is based on the first aspect thereof, and provides an ETC system wherein the vehicle sensor is only one in the ETC system.

DESCRIPTION OF THE PREFERRED EMBODIMENT

A background-art ETC system for a toll road will be explained below for a better understanding of this invention.

Figure 1:
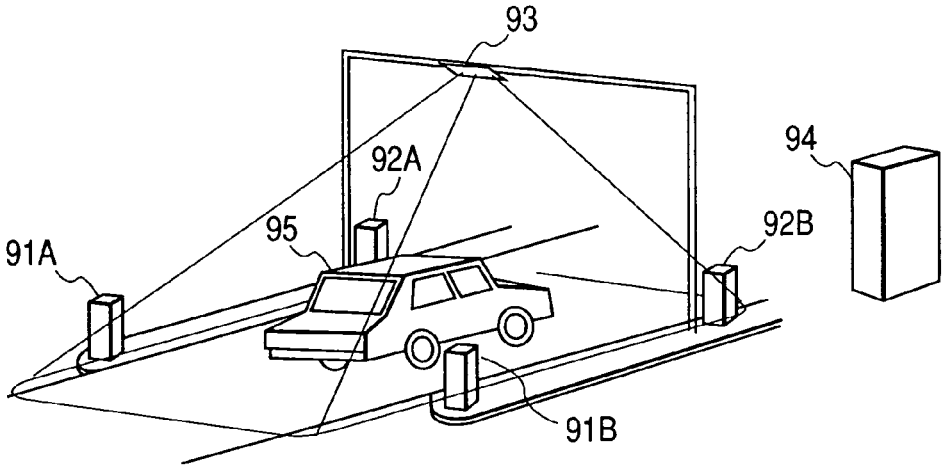
FIG. 1 is a perspective view of a tollgate in a background-art ETC system for a toll road which is not prior art against this invention.
Figure 2:
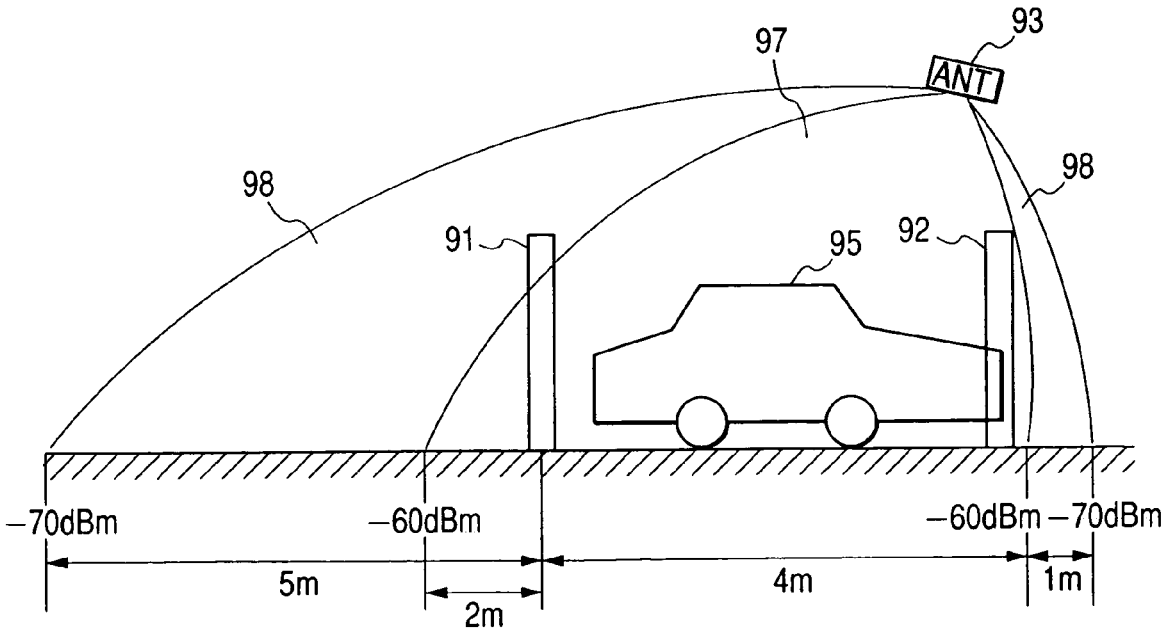
FIG. 2 is a diagrammatic side view of the tollgate in FIG. 1.
Figure 3:
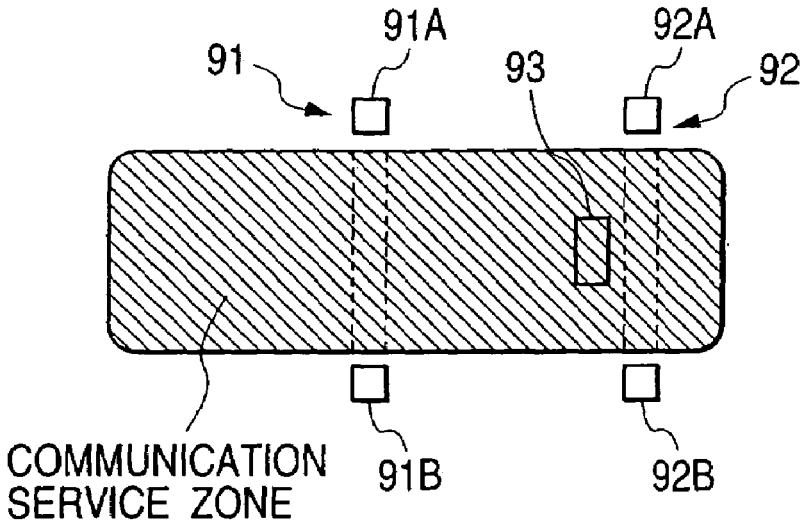
FIG. 3 is a plan view of the tollgate in FIG. 1.

FIGS. 1, 2, and 3 show a tollgate in a background-art ETC system for a toll road which is not prior art against this invention. As shown in FIGS. 1, 2, and 3, the tollgate includes a first vehicle sensor 91 composed of a photo-transmitter 91A and a photo-receiver 91B, and a second vehicle sensor 92 composed of a photo-transmitter 92A and a photo-receiver 92B.

The photo-transmitter 91A and the photo-receiver 91B in the first vehicle sensor 91 are located at the opposite sides of a lane, respectively. The photo-transmitter 91A emits a light beam toward the photo-receiver 91B along an optical path perpendicular to the lane. The light beam does not reach the photo-receiver 91B when a vehicle 95 blocks the optical path. The light beam reaches the photo-receiver 91B in the absence of a vehicle 95 from the optical path. The photo-receiver 91B converts the presence and the absence of the received light beam into an electric signal representing whether or not a vehicle 95 is in a lane position corresponding to the position of the first vehicle sensor 91. The photo-receiver 91B outputs the electric signal as an output signal of the first vehicle sensor 91.

Similarly, the photo-transmitter 92A and the photo-receiver 92B in the second vehicle sensor 92 are located at the opposite sides of the lane, respectively. The second vehicle sensor 92 generates and outputs an electric signal representing whether or not a vehicle 95 is in a lane position corresponding to the position of the second vehicle sensor 92. The position of the second vehicle sensor 92 relative to the lane precedes the position of the first vehicle sensor 91 by an interval of about 4 m.

As shown in FIGS. 1, 2, and 3, the tollgate in the background-art ETC system includes an antenna 93 located above the lane. The tollgate also includes a machine box 94 located at one side of the lane.

Figure 4:
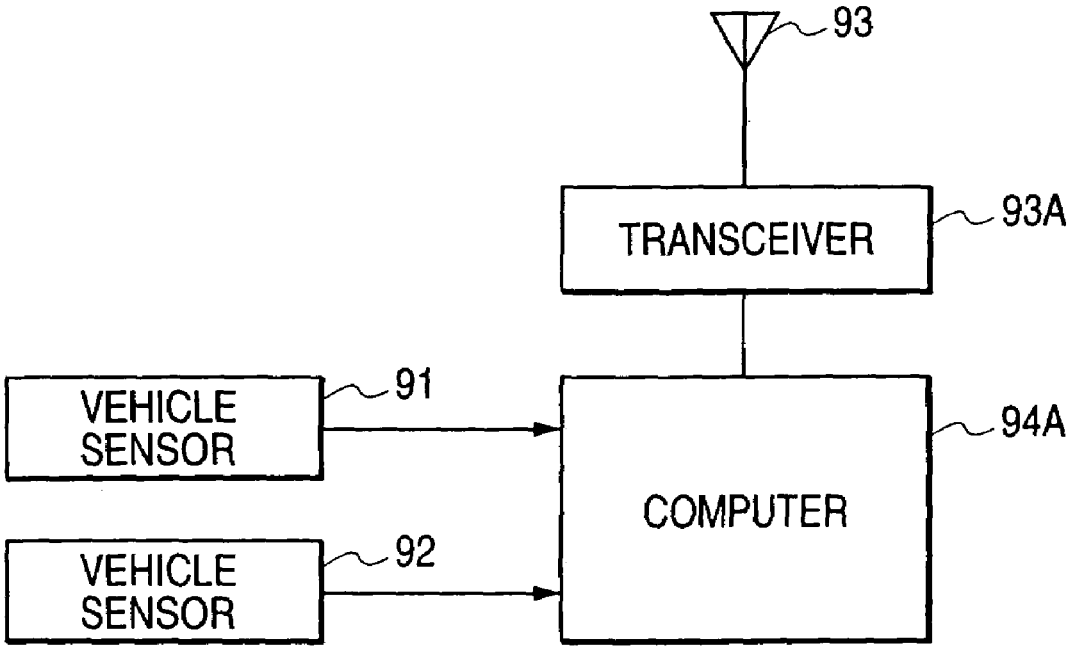
FIG. 4 is a block diagram of an electronic portion of the background-art ETC system in FIG. 1.

As shown in FIG. 4, the background-art ETC system has a computer 94A contained in the machine box 94 (see FIG. 1). The computer 94A is electrically connected to the first vehicle sensor 91 and the second vehicle sensor 92. In addition, the computer 94A is connected to a radio transceiver 93A. The radio transceiver 93A is connected to the antenna 93. The computer 94A includes a combination of an input/output port, a CPU, a ROM, and a RAM. The computer 94A operates in accordance with a control program stored in the ROM.

The radio transceiver 93A is controlled by the computer 94A, feeding a radio signal to the antenna 93. The antenna 93 radiates the radio signal toward the lane as a downward radio signal. Every ETC vehicle has an on-vehicle machine including a combination of an antenna and a radio transceiver. The on-vehicle machine can receive the downward radio signal. The on-vehicle machine can transmit an upward radio signal. The upward radio signal is received by the antenna 93. The received radio signal is fed from the antenna 93 to the radio transceiver 93A.

The control program for the computer 94A has a segment which is executed for every incoming vehicle. Specifically, a step "1" in the program segment decides whether or not a vehicle reaches the lane position of the first vehicle sensor 91 by referring to the output signal therefrom. When a vehicle reaches the lane position of the first vehicle sensor 91, the program advances from the step "1" to a step "2". Otherwise, the step "1" is repeated.

The step "2" controls the radio transceiver 93A to start radio communication with the incoming vehicle. Specifically, the radio transceiver 93A outputs a radio signal to the antenna 93. The radio signal is radiated from the antenna 93 as a downward radio signal. In the case where the incoming vehicle is an ETC vehicle, the on-vehicle machine of the incoming vehicle receives the downward radio signal and transmits an upward radio signal in response to the received downward radio signal. The upward radio signal is a response to the downward radio signal. The upward radio signal contains ID (identification) information, departure-place information, and information of places through which the vehicle passed. The upward radio signal is received by the antenna 93. The received radio signal is fed from the antenna 93 to the radio transceiver 93A. The radio transceiver 93A extracts the information from the received radio signal. The radio transceiver 93A outputs the extracted information to the computer 94A. In this case, the computer 94A is notified that a response to the downward radio signal has successfully come from the incoming vehicle. On the other hand, in the case where the incoming vehicle is a non-ETC vehicle, any upward radio signal is not received by the antenna 93 and hence the radio transceiver 93A informs the computer 94A that a response to the downward radio signal has failed to come from the incoming vehicle.

A step "3" following the step "2" decides whether or not a response to the downward radio signal has successfully come from the incoming vehicle by referring to the information given by the radio transceiver 93A. When a response to the downward radio signal has successfully come from the incoming vehicle, the computer 94A judges the incoming vehicle to be an ETC vehicle. In this case, the program advances from the step "3" to a step "4". When a response to the downward radio signal has failed to come from the incoming vehicle, the computer 94A judges the incoming vehicle to be a non-ETC vehicle. In this case, the program advances from the step "3" to a step "6".

The step "4" implements an accounting process related to the incoming vehicle. A step "5" following the step "4" decides whether or not the incoming vehicle reaches the lane position of the second vehicle sensor 92 by referring to the output signal therefrom. When the incoming vehicle reaches the lane position of the second vehicle sensor 92, the program advances from the step "5" to a step "8". Otherwise, the step "5" is repeated.

Similarly, the step "6" decides whether or not the incoming vehicle reaches the lane position of the second vehicle sensor 92 by referring to the output signal therefrom. When the incoming vehicle reaches the lane position of the second vehicle sensor 92, the program advances from the step "6" to a step "7". Otherwise, the step "6" is repeated.

The step "7" controls a suitable apparatus (not shown) to guide the incoming vehicle to a tollbooth and to instruct the incoming vehicle to pause at the tollbooth for manually paying toll. After the step "7", the program advances to the step "8".

The step "8" controls the radio transceiver 93A to terminate radio communication with the incoming vehicle. After the step "8", the program returns to the step "1".

As best shown in FIG. 2, the tollgate of the background-art ETC system has a predetermined radio-communication service zone 97 spreading from the antenna 93 to the surface of the lane. Within the predetermined service zone 97, the intensity of a downward radio signal which has been radiated from the antenna 93 is equal to or greater than a rating level, for example, −60 dBm. When an ETC vehicle is in the predetermined service zone 97, radio access thereto (radio communication therewith) can be executed. The predetermined service zone 97 is designed to just cover the region of the lane between the position of the first vehicle sensor 91 and the position of the second vehicle sensor 92. Specifically, the predetermined service zone 97 extends from a place following the position of the first vehicle sensor 91 by an interval of 2 m to a place substantially coincident with the position of the second vehicle sensor 92.

The predetermined service zone 97 is surrounded by a zone 98 forming a pseudo service zone. Within the pseudo service zone 98, the intensity of a downward radio signal is equal to or greater than a certain level, for example, −70 dBm at which radio communication with an ETC vehicle may be established. For example, the pseudo service zone 98 extends from a place following the position of the first vehicle sensor 91 by an interval of 5 m to a place preceding the position of the second vehicle sensor 92 by an interval of 1 m.

The background-art ETC system tends to erroneously judge a non-ETC vehicle to be an ETC vehicle in conditions mentioned below. When a non-ETC vehicle (a first incoming vehicle) immediately followed by an ETC vehicle (a second incoming vehicle) reaches the lane position of the first vehicle sensor 91, a downward radio signal is radiated from the antenna 93. In the case where the ETC vehicle (the second incoming vehicle) has already reached the pseudo service zone 98 at this moment, the ETC vehicle may respond to the downward radio signal while the non-ETC vehicle (the first incoming vehicle) does not respond thereto. The computer 94A is caused by the response from the second incoming vehicle to erroneously judge the first incoming vehicle to be an ETC vehicle.

EMBODIMENT

Figure 5:
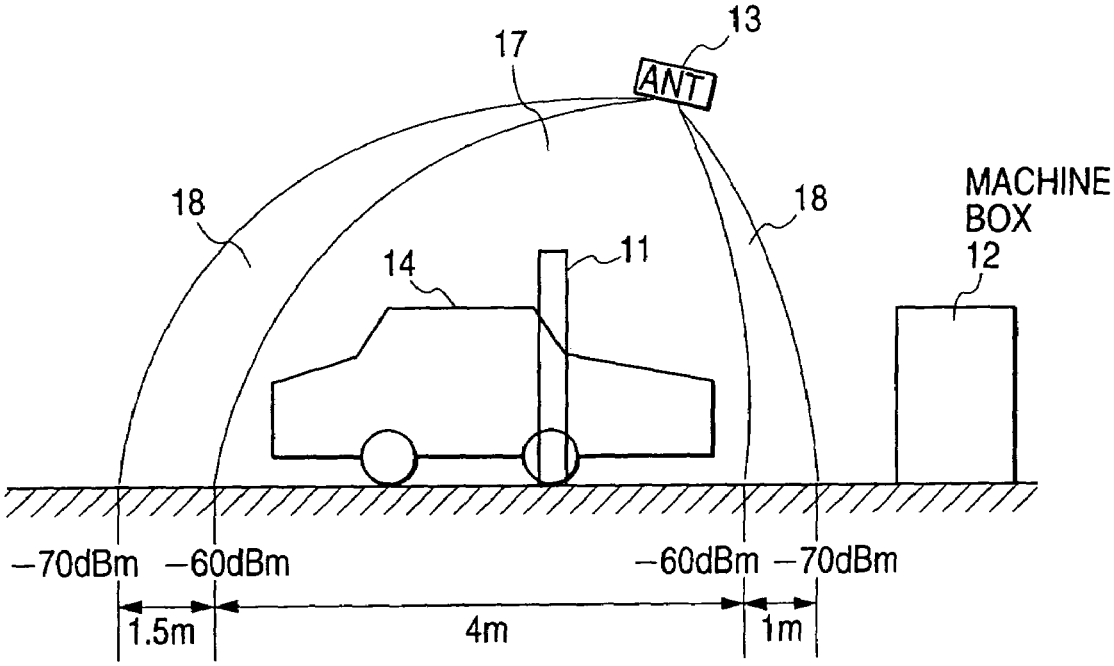
FIG. 5 is a diagrammatic side view of a tollgate in an ETC system according to an embodiment of this invention.
Figure 6:
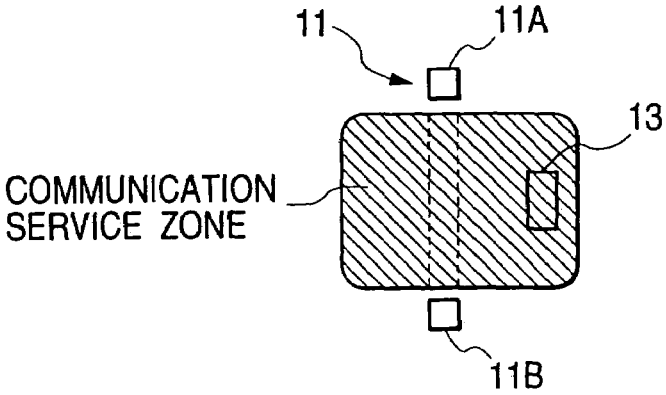
FIG. 6 is a plan view of the tollgate in FIG. 5.

FIGS. 5 and 6 show a tollgate in an ETC system for a toll road according to an embodiment of this invention. As shown in FIGS. 5 and 6, the tollgate includes a vehicle sensor 11 of an optical type. The vehicle sensor 11 is composed of a photo-transmitter 11A and a photo-receiver 11B.

The photo-transmitter 11A and the photo-receiver 11B are located at the opposite sides of a lane, respectively. The photo-transmitter 11A emits a light beam toward the photo-receiver 11B along an optical path perpendicular to the lane.

The light beam does not reach the photo-receiver 11B when a vehicle 14 blocks the optical path. The light beam reaches the photo-receiver 11B in the absence of a vehicle 14 from the optical path. The photo-receiver 11B converts the presence and the absence of the received light beam into an electric signal representing whether or not a vehicle 14 is in a lane position corresponding to the position of the vehicle sensor 11. The photo-receiver 11B outputs the electric signal as an output signal of the vehicle sensor 11.

As shown in FIGS. 5 and 6, the tollgate includes an antenna 13 located above the lane. Specifically, the antenna 13 is directly above a position on the lane which precedes the position of the vehicle sensor 11 by a predetermined interval, for example, about 1 m. The tollgate also includes a machine box 12 located at one side of the lane.

Figure 7:
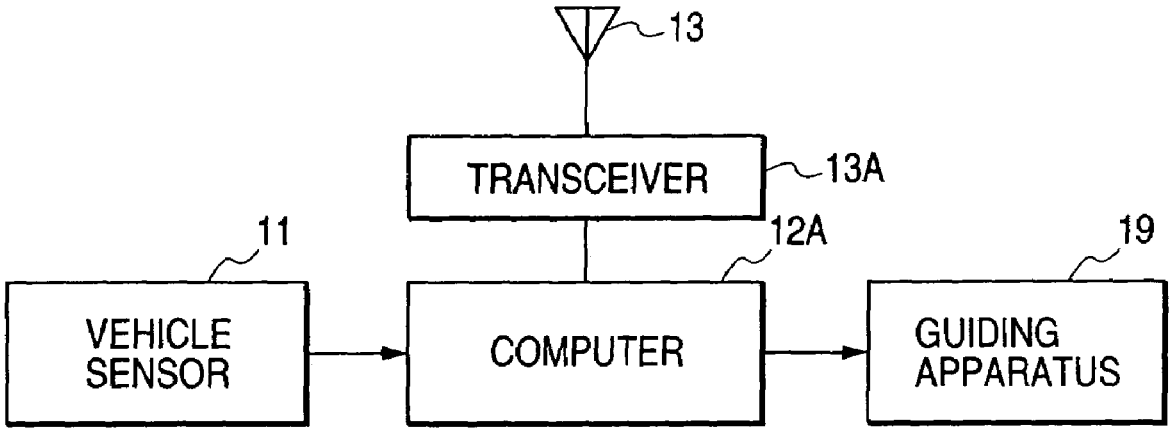
FIG. 7 is a block diagram of an electronic portion of the ETC system in FIG. 5.

As shown in FIG. 7, the ETC system has a computer 12A contained in the machine box 12 (see FIG. 5). The computer 12A is electrically connected to the vehicle sensor 11. In addition, the computer 12A is connected to a radio transceiver 13A. The radio transceiver 13A is connected to the antenna 13. The computer 12A is connected to a suitable apparatus (a guiding apparatus) 19 designed to guide an incoming vehicle to a tollbooth and to instruct the incoming vehicle to pause at the tollbooth for manually paying toll. The computer 12A includes a combination of an input/output port, a CPU, a ROM, and a RAM. The computer 12A operates in accordance with a control program stored in the ROM.

The radio transceiver 13A is controlled by the computer 12A, feeding a radio signal to the antenna 13. The antenna 13 radiates the radio signal toward the lane as a downward radio signal. Every ETC vehicle has an on-vehicle machine including a combination of an antenna and a radio transceiver. The on-vehicle machine can receive the downward radio signal. The on-vehicle machine can transmit an upward radio signal. The upward radio signal is received by the antenna 13. The received radio signal is fed from the antenna 13 to the radio transceiver 13A.

As shown in FIG. 5, the tollgate of the ETC system has a predetermined radio-communication service zone 17 spreading from the antenna 13 to the surface of the lane. Within the predetermined service zone 17, the intensity of a downward radio signal which has been radiated from the antenna 13 is equal to or greater than a rating level, for example, −60 dBm. When an ETC vehicle is in the predetermined service zone 17, radio access thereto (radio communication therewith) can be executed. The predetermined service zone 17 is designed to extend in a given region of the lane which contains the position of the vehicle sensor 11, and which has a length greater than the length of a standard vehicle and smaller than twice the length of the standard vehicle. For example, the predetermined service zone 17 has a length of about 4 m along the lane. For example, the position of the vehicle sensor 11 is rearward separate from the front edge of the predetermined service zone 17 by an interval of about 1 m.

The predetermined service zone 17 is surrounded by a zone 18 forming a pseudo service zone. Within the pseudo service zone 18, the intensity of a downward radio signal is equal to or greater than a certain level, for example, −70 dBm at which radio communication with an ETC vehicle may be established. The antenna 13 is designed to feature a predetermined directivity which causes the pseudo service zone 18 to be relatively narrow. For example, on the surface of the lane, the pseudo service zone 18 extends from a place following the rear edge of the predetermined service zone 17 by an interval of about 1.5 m to a place preceding the front edge of the predetermined service zone 17 by an interval of about 1 m.

Preferably, the whole service zone equal to the combination of the predetermined service zone 17 and the pseudo service zone 18 has a length along the lane which is greater than the length of a standard vehicle and smaller than twice the length of the standard vehicle. For example, the length of the whole service zone is equal to about 6.5 m.

Figure 8:
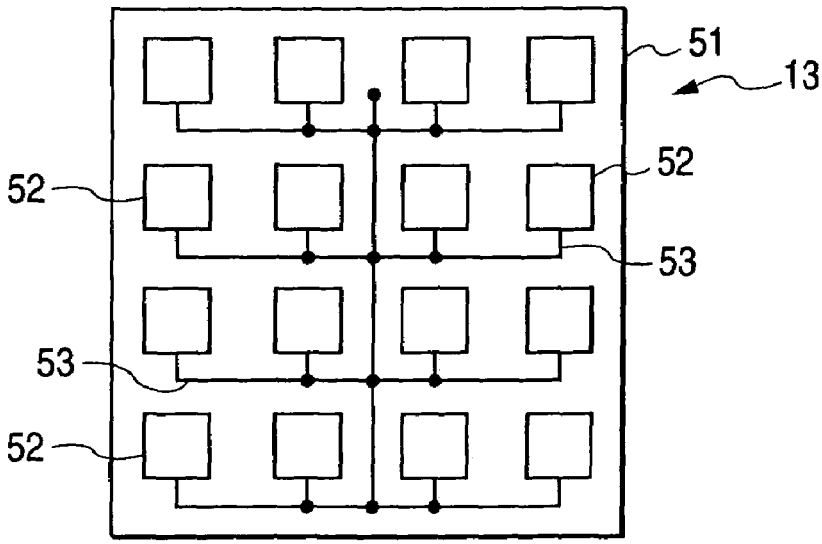
FIG. 8 is a plan view of an antenna in FIG. 5.

As shown in FIG. 8, the antenna 13 includes an insulating base board (an insulating substrate) 51, patch antenna elements 52, and feeder lines 53. The patch antenna elements 52 are formed on the insulating base board 51. The patch antenna elements 52 are arranged in a suitable array, for example, a two-dimensional matrix array. Each of the patch antenna elements 52 has a rectangular electrically-conductive plate. The feeder lines 53 are formed on the insulating base board 51. The feeder lines 53 are connected to the patch antenna elements 52, respectively. Radio power can be fed from the radio transceiver 13A (see FIG. 7) to the patch antenna elements 52 via the feeder lines 53. The number of the patch antenna elements 52 and the array of the patch antenna elements 52 are designed to provide the previously-mentioned predetermined directivity.

The control program for the computer 12A is designed to continuously activate the radio transceiver 13A. Accordingly, the radio transceiver 13A continuously outputs a radio signal to the antenna 13, and the antenna 13 continuously radiates the radio signal as a downward radio signal. In the case where an ETC vehicle comes in, the on-vehicle machine of the ETC vehicle receives the downward radio signal and transmits an upward radio signal in response to the received downward radio signal. The upward radio signal is a response to the downward radio signal. The upward radio signal contains ID (identification) information, departure-place information, and information of places through which the vehicle passed. The upward radio signal is received by the antenna 13. The received radio signal is fed from the antenna 13 to the radio transceiver 13A. The radio transceiver 13A extracts the information from the received radio signal. The radio transceiver 13A outputs the extracted information to the computer 12A. In this case, the computer 12A is notified that a response to the downward radio signal has come from an incoming vehicle. On the other hand, in the case where a non-ETC vehicle comes in, any upward radio signal is not received by the antenna 13 and hence the radio transceiver 13A continues to inform the computer 12A that any response to the downward radio signal does not come.

Figure 9:
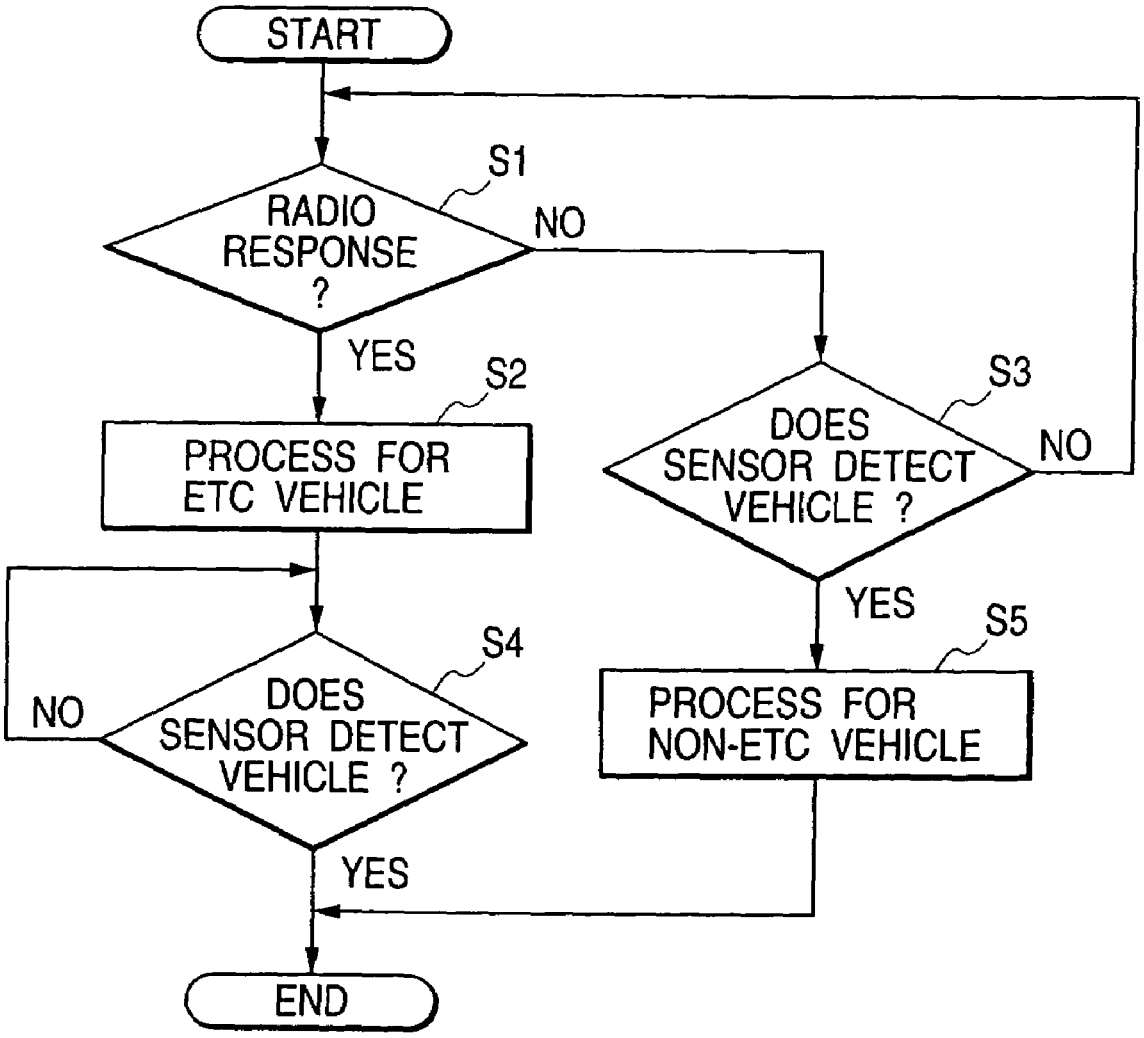
FIG. 9 is a flowchart of a segment of a control program for a computer in FIG. 7.

FIG. 9 shows a segment of the control program for the computer 12A which is iterated, and which is executed for every incoming vehicle. As shown in FIG. 9, a first step S1 of the program segment decides whether or not a response to the downward radio signal is received by referring to the information given by the radio transceiver 13A. When a response to the downward radio signal is received, the computer 12A judges that there is an ETC vehicle incoming. In this case, the program advances from the step S1 to a step S2. When a response to the downward radio signal is not received, the program advances from the step S1 to a step S3.

The step S2 implements an accounting process related to the incoming ETC vehicle. A step S4 following the step S2 decides whether or not the incoming ETC vehicle reaches the lane position of the vehicle sensor 11 by referring to the output signal therefrom. When the incoming ETC vehicle reaches the lane position of the vehicle sensor 11, the program exists from the step S4 and then the current execution cycle of the program segment ends.

The step S3 decides whether or not an incoming vehicle reaches the lane position of the vehicle sensor 11 by referring to the output signal therefrom. When an incoming vehicle reaches the lane position of the vehicle sensor 11, the computer 12A judges that there is a non-ETC vehicle incoming. In this case, the program advances from the step S3 to a step S5. When any incoming vehicle does not reach the lane position of the vehicle sensor 11, the program returns from the step S3 to the step S1.

The step S5 controls the guiding apparatus 19 to guide the incoming non-ETC vehicle to a tollbooth and to instruct the incoming non-ETC vehicle to pause at the tollbooth for manually paying toll. After the step S5, the current execution cycle of the program segment ends.

As previously mentioned, the downward radio signal is continuously radiated from the antenna 13. When a response to the downward radio signal is received, the computer 12A judges that there is an ETC vehicle incoming. In the case where an incoming vehicle is detected by the vehicle sensor 11 while any response to the downward radio signal is not received, the computer 12A judges that there is a non-ETC vehicle incoming. Since only one standard vehicle can be contained in the whole radio-communication service zone (the predetermined service zone 17 plus the pseudo service zone 18), an incoming non-ETC vehicle can be correctly detected even when the incoming non-ETC vehicle is immediately followed by an ETC vehicle.

The ETC-system tollgate in FIGS. 5 and 6 has only one vehicle sensor 11. Therefore, the ETC-system tollgate is relatively inexpensive.

The antenna 13 may be replaced by another directional antenna. The vehicle sensor 11 may be of a type different from the optical type.

What is claimed is:

1. An ETC (electronic toll collection) system, consisting of:

an antenna having a predetermined directivity for providing a limited radio-communication service zone that extends from the antenna and covers at least a portion of the area of a lane under the antenna, and which length along the lane is set to a distance which approximates a single vehicle;

a single vehicle sensor within said system and positioned within said service zone at a location closer to oncoming vehicles than said antenna by a predetermined interval for detecting a vehicle which reaches a predetermined position defined in the limited radio-communication service zone, the predetermined position being defined by the location of the vehicle sensor such that only one vehicle is within said service zone and sensed by said vehicle sensor at any one time;

first means for continuously transmitting a radio signal via the antenna independently of whether or not the vehicle sensor detects the vehicle;

second means for deciding whether or not a radio response from a vehicle to the radio signal is received via the antenna;

third means for, in cases where the second means decides that a radio response to the radio signal is received, judging that there is an ETC vehicle coming into the limited radio-communication service zone in response to the detection of a vehicle by said sensor within said service zone; and fourth means for, in cases where the vehicle sensor detects a vehicle while the second means decides that a radio response to the radio signal is not received, judging that there is a non-ETC vehicle coming into the limited radio-communication service zone.

2. An ETC system as recited in claim 1, wherein the distance of the limited radio-communication service zone is greater than a length of the vehicle and smaller than twice the length of said vehicle.

3. An ETC system as recited in claim 2, wherein the distance of the limited radio-communication service zone is about 6.5 m.

4. An ETC system as recited in claim 1, wherein the length of the limited radio-communication service zone is about 6.5 m.

5. An ETC system as recited in claim 1, wherein the antenna is one in number.

6. An ETC system as recited in claim 1, wherein the antenna comprises a matrix array of antenna elements.

7. An ETC (Electronic Toll Collection) system, consisting of:

an antenna having a predetermined directivity for providing a limited radio-communication service zone that extends from the antenna and covers at least a portion of the area of a lane under the antenna, and which length along the lane is set to a distance which approximates a single vehicle;

a single vehicle sensor within said system and positioned at a location within said service zone closer to oncoming vehicles than said antenna by a predetermined interval for detecting whether a vehicle has reached a predetermined position defined in said limited radio-communication service zone, the predetermined position being defined by the location of the vehicle sensor such that only one vehicle is within said service zone and sensed by said vehicle sensor at any one time;

transceiver means working cooperatively with said antenna for continuously transmitting a radio signal at a given rating level to cover the limited radio-communication service zone independently of whether or not the vehicle sensor within said radio-communication service zone detects a vehicle and for detecting a radio response to said radio signal from each vehicle detected by said vehicle sensor within said radio-communication service zone; and processor means for deciding a vehicle that has been detected by said vehicle sensor in said radio-communication service zone is a non-ETC vehicle if no radio response to said radio signal is detected from said vehicle.

8. An ETC system of claim 7, wherein said processor means decides a vehicle that has been detected by said vehicle sensor in said radio-communication zone is an ETC vehicle if a radio response to said radio signal is detected from said vehicle.

9. An ETC system as recited in claim 7, wherein the antenna comprises a matrix array of antenna elements.

10. An ETC system as recited in claim 7, wherein the distance of the limited radio-communication service zone is greater than a length of the vehicle and smaller than twice the length of said vehicle.

11. An ETC (Electronic Toll Collection) system, consisting of:

an antenna for directing a limited radio-communication service zone to cover at least a portion of the area of a lane under the antenna, the distance along the lane covered by said antenna approximating the length of a single vehicle;

a single vehicle sensor within said system and positioned at a location within said service zone closer to oncoming vehicles than said antenna by a predetermined interval for detecting whether a vehicle has reached a predetermined position in said limited radio-communication service zone, the predetermined position being defined by the location of said vehicle sensor such that only one vehicle is within said service zone and sensed by said vehicle sensor at any one time;

a transceiver working cooperatively with said antenna for continuously transmitting a radio signal to the limited radio-communication service zone independently of whether or not the vehicle sensor within said radio-communication service zone detects a vehicle and for detecting a radio response to said radio signal from each vehicle detected by said vehicle sensor within said radio-communication service zone; and a processor for deciding a vehicle that has been detected by said vehicle sensor in said radio-communication service zone is a no-ETC vehicle if no radio response to said radio signal is detected from said vehicle.

* * * * *

UNITED STATES PATENT AND TRADEMARK OFFICE

CERTIFICATE OF CORRECTION

PATENT NO. : 7,181,414 B1
APPLICATION NO. : 09/394514
DATED : February 20, 2007
INVENTOR(S) : Takao Ogawa et al.

It is certified that error appears in the above-identified patent and that said Letters Patent is hereby corrected as shown below:

Title page; item 56
OTHER PUBLICATIONS

Bair, Jeffrey, "AT&T, Lockhead join to create 'smart' roads," Huston Chronical, April 13, 1992.

change to

Bair, Jeffrey, "AT&T, Lockheed join to create 'smart' roads," Huston Chronical, April 13, 1992.

Signed and Sealed this

Fifteenth Day of May, 2007

JON W. DUDAS
*Director of the United States Patent and Trademark Office*